US005153956A

United States Patent [19]

Nold

[11] Patent Number: 5,153,956

[45] Date of Patent: Oct. 13, 1992

[54] LOWERING UNIT AREA PRESSURE

[75] Inventor: Heinz Nold, Wynigen, Switzerland

[73] Assignee: Bruno Fronebner, Switzerland

[21] Appl. No.: 629,831

[22] Filed: Dec. 19, 1990

[30] Foreign Application Priority Data

Dec. 21, 1989 [GB] United Kingdom ..... 8928826

[51] Int. Cl.[5] ..... A47C 27/14; A61G 7/04

[52] U.S. Cl. ..... 5/448; 5/481; 5/468; 5/900.5

[58] Field of Search ..... 5/448, 455, 461, 468, 5/481, 653, 900.5

[56] References Cited

U.S. PATENT DOCUMENTS

| | | | |
|---|---|---|---|
| 1,904,039 | 4/1933 | Bruder . | |
| 2,548,547 | 4/1951 | Melrose . | |
| 3,812,001 | 5/1974 | Ryan | 5/484 X |
| 3,866,252 | 2/1975 | Rogers, Jr. | 5/481 |
| 4,383,342 | 5/1983 | Forster | 5/432 |
| 4,605,582 | 8/1986 | Sias et al. | 5/461 X |
| 4,686,724 | 8/1987 | Bedford | 5/468 |
| 4,713,854 | 12/1987 | Graebe | 5/481 |
| 4,866,800 | 9/1989 | Bedford | 5/468 |
| 4,901,387 | 2/1990 | Luke | 5/468 X |
| 4,961,982 | 10/1990 | Taylor | 5/484 X |
| 4,962,553 | 10/1990 | Marquis | 5/465 X |
| 4,967,433 | 11/1990 | Neal | 5/481 |

FOREIGN PATENT DOCUMENTS

| | | |
|---|---|---|
| 2460650 | 1/1981 | France . |
| 2479687 | 10/1981 | France . |
| 2616320 | 12/1988 | France . |
| 921098 | 3/1963 | United Kingdom . |

*Primary Examiner*—Michael F. Trettel

*Attorney, Agent, or Firm*—Ostrolenk, Faber, Gerb & Soffen

[57] ABSTRACT

A cushioning layer for lowering the unit area pressure between a supporting surface and an irregularly shaped body and comprising a flexible base layer (10); and a plurality of resilient, shaped protrusions (11), each protrusion upstanding from said base layer and arranged to contact a surface of said body; wherein said cushioning layer is capable of resilient compression by way of deflection of said protrusions (11) thereby to reduce the unit area pressure between the supporting surface and the body, and to permit air to circulate between the protrusions (11) and to contact the body surface.

18 Claims, 5 Drawing Sheets

LOWERING UNIT AREA PRESSURE

DESCRIPTION

This invention relates to the support of bodies and has particular reference to a method of lowering unit area pressure between the surface of an irregularly shaped body and a support or bed therefor.

In particular the invention is concerned with, although not exclusively restricted to, the comfort of a human body or the like when laying on a bed or surface. The invention is particularly useful in preventing decubitus or "bed sores".

The requirement to provide a cushioning action by equalizing pressure over the surface of an irregularly shaped body is generally well known, and hitherto the means of providing such support has been by means of water beds, air beds and the like.

To provide a comfortable bed or surface on which a body can lay or sit, or to support bodies or limbs in a horizontal, inclined or vertical position, comfort during rest, work or sleep is probably the main consideration. For a fit human or animal, comfort in a given supported position is dependent on reducing the pressure per unit area of body into those portions of the body and limbs which are more readily able to receive such pressure.

Where, however, a person is disabled, then prolonged confinement in one position upon a bed results, after a period time, in increasing discomfort and eventually bed sores when decubitus sets in. If, therefore, a person is unable to move, or unable to move very much, then various parts of the body are almost permanently in contact with bedding and sheeting and the lack of circulation of air to those parts of the body so in contact with the sheeting and bedding plus the humidity, perspiration and other body excrements which may be present in the sheeting of bedding, affects those areas of the skin which rub against the sheetings and this affects the skin and impairs the blood circulation. Creases in the sheeting and underclothes and the like will aggravate the condition.

Many systems have been proposed to reduce or prevent decubitus or simply the discomfort that arises prior to decubitus setting in. None of these has been proved to be entirely satisfactory.

Rubber rings and water cushions do not help, they simply move the problem from one part of the body to another due to the tight seal created if a body rests on either the ring or the water cushion since this prevents the skin from breathing.

Air beds give reasonably good results, but their cost is high and they are costly to run and maintain. In consequence, they are used only in the treatment of very severe burns.

The use of genuine sheepskins has been proposed but they were found to retain moisture after a relatively short time and they are difficult to clean and sterilize after cleaning.

Non-woven textile sheet material has been used in different variations, all of these have been found to retain moisture to a greater or lesser extent and, of course, they inhibit the free circulation of air in juxtaposition the skin of the person reclining thereon.

According to one aspect of the present invention there is provided a method of supporting a body by reducing unit area pressure which method comprises providing a surface for the support of an irregularly shaped body, said surface being formed by a cushioning layer having a plurality of shaped protrusions arranged to contact said body, said cushioning layer being capable of reversible compression whereby the body is supported so that air can circulate between the protrusions to contact the body surface, and the degree of compression is such that the cushioning layer is capable of yielding further if movement of the body results in the application of a greater weight to a given area of the surface.

As used herein the term "compressibility" is to be understood to be the reversible decrease of thickness of the cushioning layer as a percentage of the thickness of the unloaded cushioning layer. For the purposes of this specification, "deflection" is to be understood to mean a lateral movement of tips of the protrusions in response to the application of a body load thereto.

The compression of the cushioning layer preferably occurs by deflection of the protrusions rather than a decrease in the length thereof.

According to a different aspect of the present invention there is provided a cushioning layer for lowering the unit area pressure between a supporting surface and an irregularly shaped body and comprising:

a flexible base layer; and a plurality of resilient, shaped protrusions, each upstanding from said base layer and arranged to contact a surface of said body; wherein said cushioning layer is capable of resilient compression by way of deflection of said protrusions thereby to reduce the unit area pressure between the supporting surface and the body, and to permit air to circulate between the protrusions and to contact the body surface.

The reversible compressiblity of the cushioning layer is preferably such that the amount of compression is within the range of 2% to 50% of the unloaded thickness. It is preferred that the compression is within the range of 5% to 25% of the original thickness. It is further preferred that in its loaded state the deflection of each protrusion does not exceed 70° from its unloaded or no load position. It is preferred that the deflection is under 45° and preferably less than 30° or even 25° in its maximum load condition.

The cushioning layer in accordance with the present invention may be a unitary construction comprising a sheet-like base having a plurality of shaped orthogonal protrusions extending upwardly therefrom.

The cushioning layer so constructed is preferably formed from a flexible material which is typically elastic and resilient like rubber; the protrusions may be adapted to yield on the application of a load thereto by deflection of the protrusions laterally in response to the load applied.

The cushioning layer may alternatively be a textile sheet material provided with loops; a typical material being a polyester filament of 850 to 900 denier with a 25–30 micron core covered with cotton yarn by, for example, core spinning.

The protrusions may be substantially regular in cross-section and preferably have rounded upper surfaces to provide a comfortable contact with a body with which it is in contact; the protrusions may be arranged on said base layer to form a regular array.

Provided the protrusions are capable of the deflection referred to above, the shape of the protrusions may be cylindrical, conal, pyramidal, or loop-shaped, the physical properties of the material being such that a body supported on the cushioning layer is always carried by the protrusions, the protrusions each of which is of sufficient dimension and substance so that at all times air can circulate between adjacent protrusions to gain access to the surface of a body supported thereon. Small movements of the supported body may change the relative loading of the protrusions on the layer, and thus there may be no distinct pressure points on the body to which air cannot circulate.

The shape and length of the individual protrusions, and the spacing between adjacent protrusions may be varied over the surface of the cushioning layer.

In a further variation of the invention, the base sheet of the cushioning layer may be provided with a plurality of holes; said holes may be disposed in a regular array. In some embodiments of the invention, holes may be provided in the base of the material in some areas of the cushioning layer but not in others. Further, the size and shape of the holes may vary over the surface of the cushioning layer.

The protrusions and/or holes of the cushioning layer may be arranged in a pattern.

The base sheet may also be associated with an absorbent layer which serves to absorb moisture, perspiration and the like thereby further enhancing the properties of the support.

Where large areas of cushioning material are required, and/or where the cushioning layer has to be handled frequently for washing, sterilizing etc., the cushioning layer, in accordance with the present invention, may advantageously be assembled from relatively smaller units which are easier to handle. The smaller units may be assembled to form the required larger area of cushioning layer by a variety of releasable fastening means such as zippers, press fasteners, male/female stud/hole systems, meshing studs, adhesive tape, or "hook and loop" fastening means such as that which is commercially available under the trade name "VELCRO". Such fastening means may be formed together with the cushioning layer during e.g. a casting operation, or it may be inserted into the mould during casting; alternatively, it may be subsequently applied to the cushioning layer.

The cushioning material, during or after its formation, may be attached to other sheet materials which, for example, may be capable of being durably shaped into any desirable shape such as a seat/backrest assembly. Alternatively, the cushioning material itself may be given a 3-dimensional shape either during casting, or subsequently by mechanical deformation.

Polymers found to be useful in the manufacture of the cushioning layer, in accordance with the present invention, and for providing properties desirable for specific applications of the cushioning layer, include elastic polymers. Such polymers may be thermoplastic or duroplastic and they comprise polymers produced by polymerization, polycondensation, copolymerization, or of polymer blends. The polymeric materials for use in manufacturing a cushioning layer according to the present invention may for, certain applications, contain cells filled with air or liquids to an extent which does not have a deleterious effect on the resilience of the protrusions of the cushioning layer.

The specific requirements of the end use of the cushioning layer determine the particular polymeric material to be used.

In the case of decubitus prevention, for example, easy cleaning, resistance to sterilizing conditions, low aqueous liquid pick up, and resistance to staining are desirable and, in this case, elastomeric silicone polymers have been found to be particularly suitable.

The present invention also comprehends beds, couchs, seats, back rests and the like incorporating the cushioning layer of the present invention.

The following is a description by way of example only and with reference to the accompanying drawings of methods of carrying the invention into effect.

In the drawings

Figure 1:
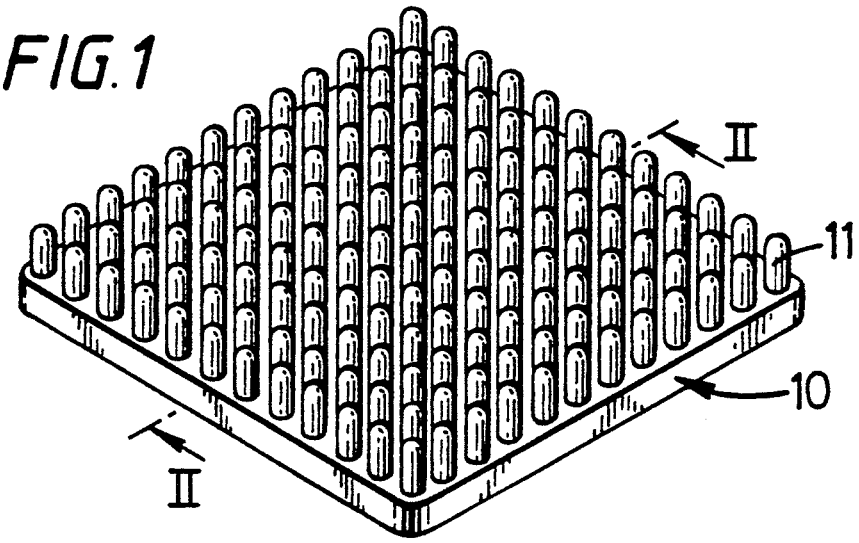
FIG. 1 is a perspective view of a typical cushioning layer in accordance with the present invention.
Figure 2:
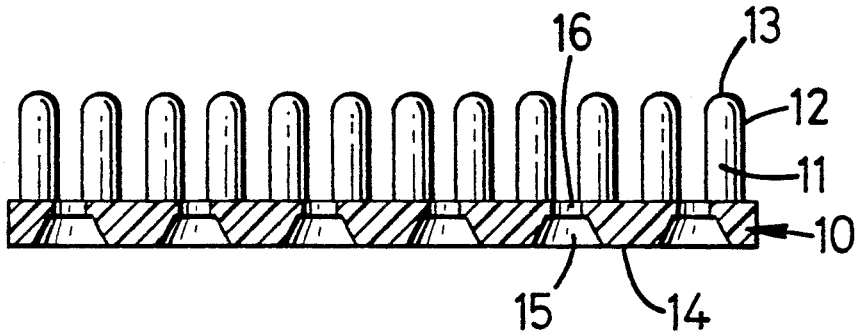
FIG. 2 is a section on the line II—II of FIG. 1.

The cushioning layer is formed from a flexible resilient plastics material, typically a silicone rubber of Shore 'A' hardness 55, and comprises a base 10 and a plurality of upwardly extending protrusions 11 which extends in uniform spaced relationship in lines and rows from base 10. Each protrusion 11 is formed substantially integrally with base 10 and comprises an upwardly extending cylindrical portion 12 having a hemispherical upper surface 13, the ratio of the height to diameter of each protrusion being approximately of the order of 3:1.

The base 10 is provided on its underside 14 with a plurality of recesses 15 each communicating with a through hole 16 which pierces base 10. Each through hole 16 is adjacent an upstanding protrusion 11, the arrangement being such that each of four upstanding protrusions are spaced about the periphery of through hole 16.

Figure 3:
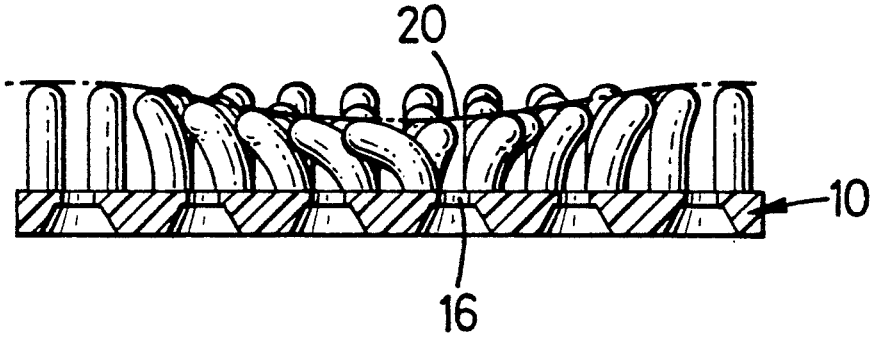
FIG. 3 is an enlarged portion of FIG. 2 showing deflection of the protrusions.
Figure 4:
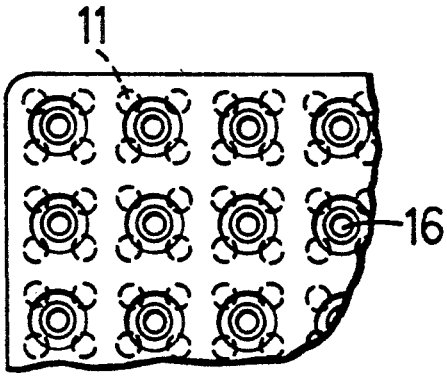
FIG. 4 is a portion of the underside of the cushioning layer of FIG. 1.
Figure 5:
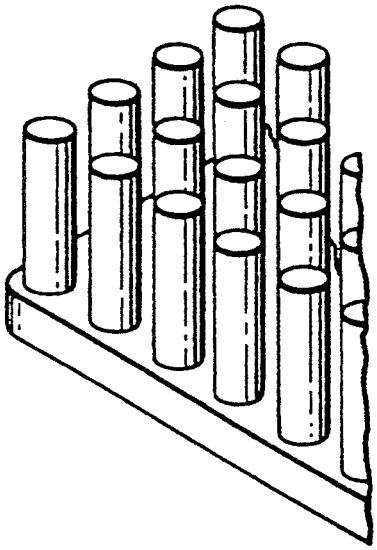
FIGS. 5–8 are portions of the cushioning layer showing the protrusions having various shapes.
Figure 6:
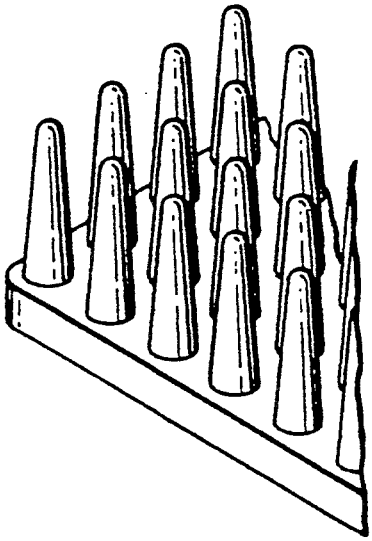
Figure 7:
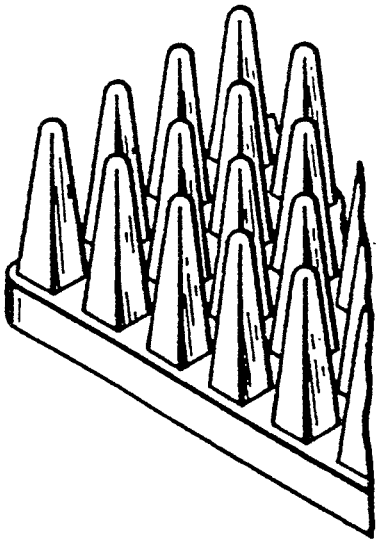
Figure 8:
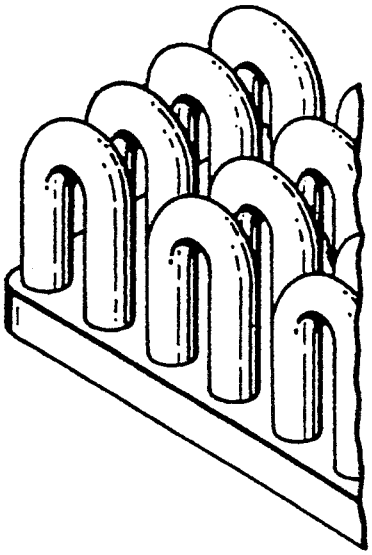
Figure 9:
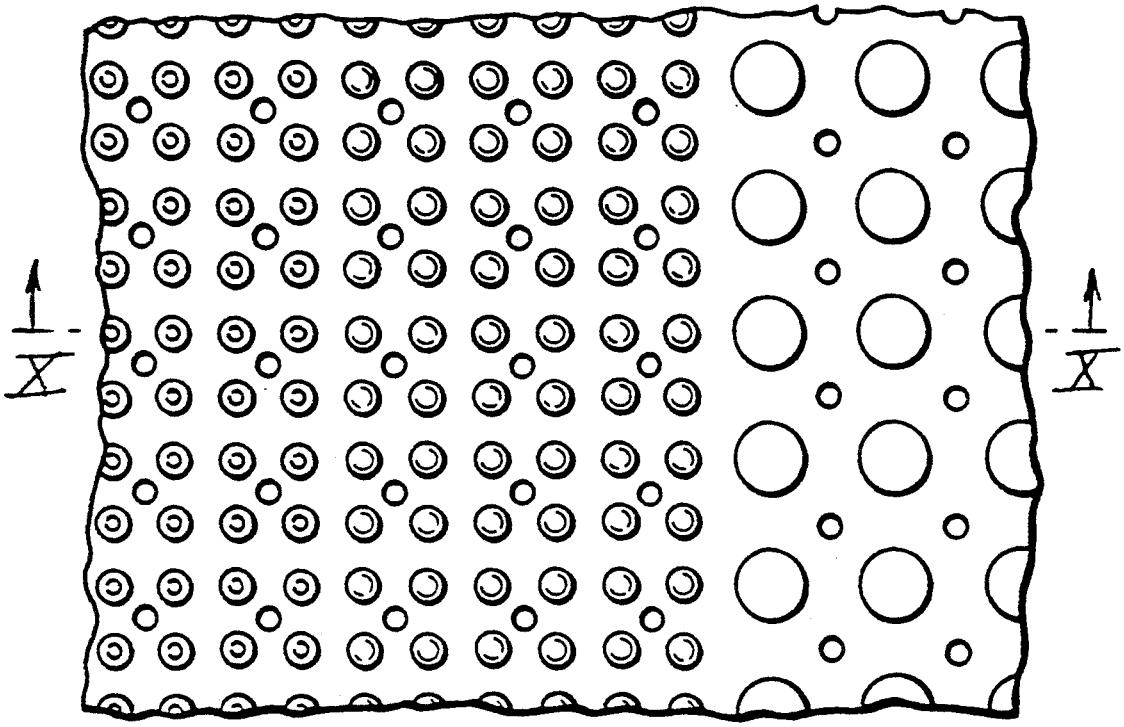
FIG. 9 is a portion of the cushioning layer showing the protrusions varying in shape, spacing and length.
Figure 10:
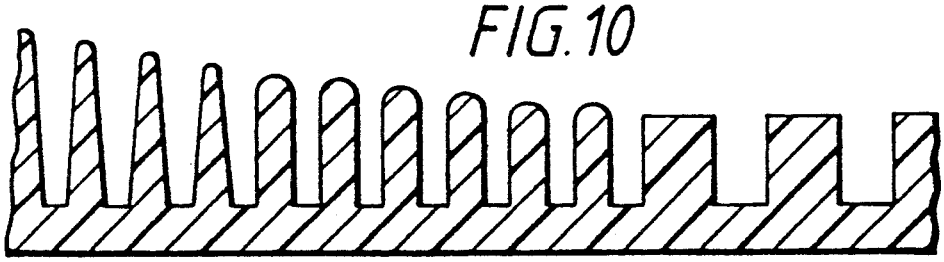
FIG. 10 is a section on the line X—X of FIG. 9.
Figure 11:
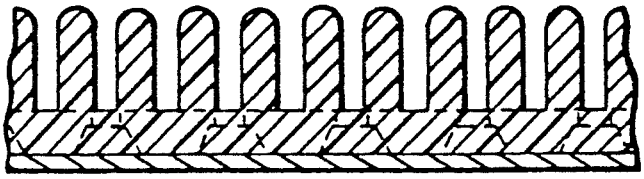
FIG. 11 is a section showing the base sheet as an absorbent layer.
Figure 12:
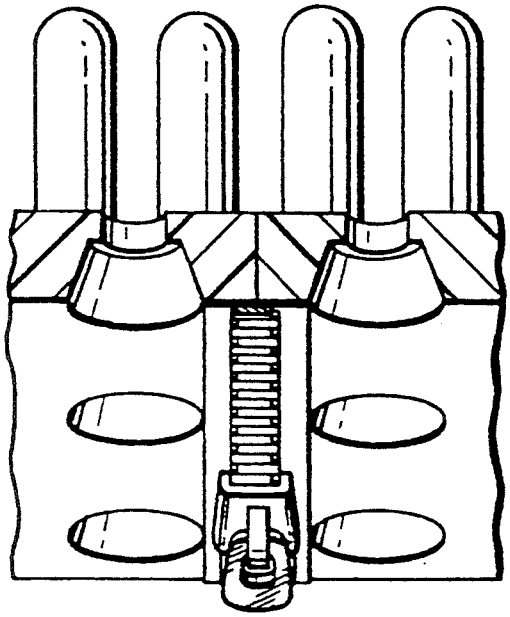
FIGS. 12–17 are sections showing various embodiments of fastening means.
Figure 13:
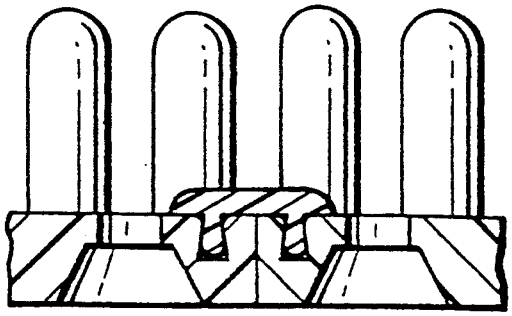
Figure 14:
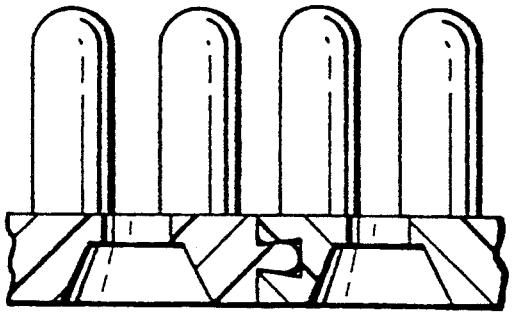
Figure 15:
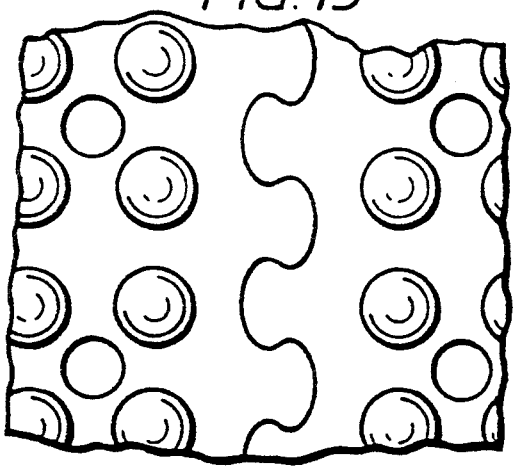
Figure 17:
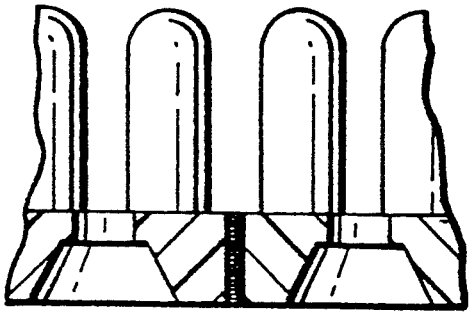
Figure 16:
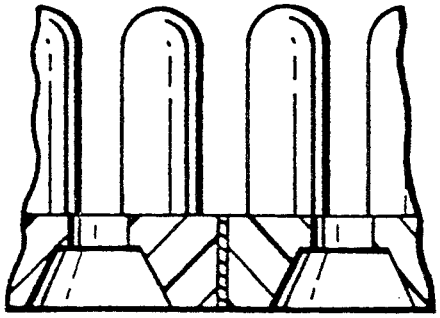
Figure 18:
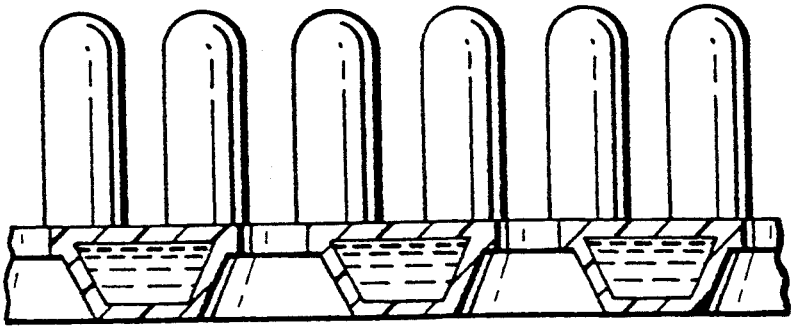
FIG. 18 is a section showing the cushioning layer formed from a material having fluid filled cells.
Figure 19:
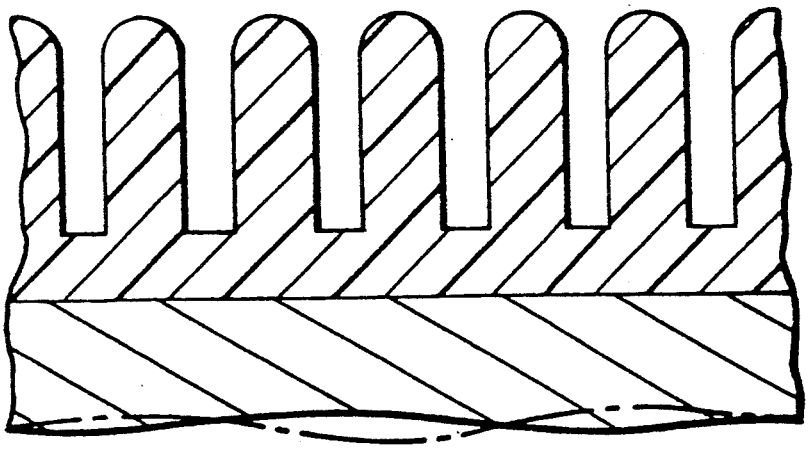
FIG. 19 is a section showing the cushioning layer with the base sheet laminated to a layer of moldable material.

The whole product is arranged so that when a load, such as a portion of the human body, is applied to the cushioning layer, the protrusions flex and bend as shown in FIG. 3, but the resilience of the protrusions is selected such that the maximum load applied does not permit complete collapse of the protrusions, and at all times air will be capable of circulating between the body surface indicated by line 20 and the base 10 by virtue of access from the underside via the through holes 16 and through the spacings between the rows and lines of protrusions 11.

The hemispherical extremity 13 of each protrusion 11 provides a high level of comfort, while at the same time permits adequate air circulation to remove water vapor thus reducing the accummulation of perspiration, which results in the wetting of the skin, sheets or clothing, and reducing the possibility of the occurence of Decubitus.

A cushioning layer as herein described provides a surface which is capable of distributing the pressure due to an irregularly shaped load or body supported thereon which acts on the underlying supporting structure, thereby to lower the unit area pressure between the body and the support structure thus providing a generally comfortable support. In use, the protrusions of the cushioning layer permit free air circulation therebetween to contact the surface of the body supported and to remove water vapor, thereby reducing the accumulation of perspiration, which otherwise may result in the wetting of the skin, sheets or clothing, and reducing the possibility of decubitus and "bed sores".

Particular applications for a cushioning layer in accordance with the present invention include seats and back rests for use in vehicles, office chairs, seats which are used in hot and/or humid environments, and, generally, seats for use in situations where people have to sit for prolonged periods of time e.g. aircraft seats. The use of a cushioning layer as herein described in or on such seats provides more comfort for bony as well as for obese people by allowing air circulation to remove humidity and by distributing the weight over a wider surface.

The cushioning layer as herein described may also increase the comfort to a body lying or sitting on such a layer by stimulating blood circulation in those parts of the body in contact with the protrusions of the cushioning layer; this effect may be enhanced when the weight of the body is shifted slightly from time to time.

I claim:

1. A cushioning layer of resilient material for lowering the unit area pressure between a supporting surface and an irregularly shaped body, said cushioning layer comprising:

a flexible base layer; and a plurality of discrete flexible protrusions, each protrusion having an elongated configuration from a single point of said base layer and being arranged to contact a surface of said body;

wherein each of said protrusions is capable of resilient deflection in any sideways direction from an unloaded position of 0° to a maximum loaded position of 70°, thereby to reduce the unit area pressure between the supporting surface of the body, and to permit air to circulate between the protrusions and to contact the body surface.

2. A cushioning layer as claimed in claim 1 wherein in a loaded state, the cushioning layer is capable of yielding further if movement of said body results in the application of a greater weight to a given area of the layer.

3. A cushioning layer as claimed in claim 1 wherein the layer has a compressibility such that in a loaded state the amount of compression is within the range of 2% to 50% of the unloaded thickness of the layer.

4. A cushioning layer as claimed in claim 1 wherein in a loaded state the deflection of each of said protrusions does not exceed 45° from its unloaded position.

5. A cushioning layer as claimed in claim 1 wherein in that said layer is a unitary construction comprising a sheet-like base having a plurality of shaped protrusions extending substantially at right angles and upwardly therefrom.

6. A cushioning layer as claimed in claim 1 wherein in that the protrusions are regular in cross-section and have rounded upper surfaces.

7. A cushioning layer as claimed in claim 1 wherein in that the protrusions are cylindrical, conal, pyramidal or loop-shaped.

8. A cushioning layer as claimed in claim 1 wherein in that one or more of the shape, length and spacing of the protrusions is varied over the surface of the cushioning layer.

9. A cushioning layer as claimed in claim 1 wherein in that said base sheet is provided with a plurality of holes.

10. A cushioning layer as claimed in claim 1 wherein in that the base sheet is associated with an absorbent layer.

11. A cushioning layer as claimed in claim 1 wherein in that said layer comprises fastening means arranged to permit the assembly of a relatively large area of cushioning layer from a plurality of relatively small areas of cushioning layer.

12. A cushioning layer as claimed in claim 11 wherein in that said fastening means are selected from zippers, press fasteners, male/female stud/hole systems, meshing studs, adhesive tape, and "hook and loop" fastening means.

13. A cushioning layer as claimed in claim 1 wherein in that said layer is formed of a thermoplastic or duraplastic polymer, copolymer or polymer blend.

14. A cushioning layer as claimed in claim 1 wherein in that the cushioning layer is formed from a material having fluid filled cells.

15. A cushioning layer as claimed in claim 1 wherein in that said cushioning layer is formed from an elastomeric silicone polymeric material.

16. A cushioning layer as claimed in claim 1 wherein in that said base sheet at least in part is laminated to a layer of material which is capable of being durably shaped into a 3-dimensional configuration.

17. A cushioning layer as claimed in claim 1 wherein in a loaded state the deflection of each of said protrusions does not exceed 30° from the unloaded position.

18. A cushioning layer as claimed in claim 1 wherein as each protrusion is deflected further from its unloaded position, said protrusion will abut a neighboring protrusion providing resistance against further deflection, thus resulting in progressive stiffening of said cushioning layer.

* * * * *